United States Patent [19]

Messana

[11] 4,418,909

[45] Dec. 6, 1983

[54] GOLF TEE

[76] Inventor: Anthony Messana, 2720 N. Ocean Blvd., Ft. Lauderdale, Fla. 33308

[21] Appl. No.: 392,644

[22] Filed: Jun. 28, 1982

[51] Int. Cl.[3] ..... A63B 57/00

[52] U.S. Cl. ..... 273/33

[58] Field of Search ..... 273/33, 212, 202, 203, 273/204, 205, 206, 207, 208, 209, 210, 211, 26 R, 25; 63/DIG. 1; 40/325, 331, 332

[56] References Cited

U.S. PATENT DOCUMENTS

| | | | |
|---|---|---|---|
| 1,572,105 | 2/1926 | Byrne | 273/209 |
| 1,573,911 | 2/1926 | Budrow | 273/211 |
| 3,721,447 | 3/1973 | Luderback | 273/208 |
| 3,782,723 | 1/1974 | Morris | 273/33 |
| 3,947,027 | 3/1976 | Brown | 273/33 |
| 4,103,888 | 8/1978 | Ricketts | 273/33 |
| 4,192,504 | 3/1980 | Clugage | 273/33 |

*Primary Examiner*—Richard C. Pinkham
*Assistant Examiner*—T. Brown
*Attorney, Agent, or Firm*—Eugene F. Malin

[57] ABSTRACT

A golf tee for improved straighter golf ball flight when hit therefrom including an adhesive means applied to all or a portion of the socket portion of the head for adherence to the golf ball placed thereon. Golf ball adhesion to the head of this golf tee provides the anti-spin characteristics necessary to reduce ball "hook" or "slice". The preferred adhesive means is a double-sided tape, however, any adhesive means may be applied on the socket of a conventional tee, the adhesive then covered to allow the tee to be stored in, for example, a golf bag, without premature adhesion to other surrounding objects. The golf tee may be of a conventional shape or may include an enlarged head portion for greater adhesive means engagement to the golf ball. However, the combination of adhesive size, tee size, and adhesive strength should not act in such combination that the tee flies with the golf ball when struck by a golf club in normal play. The preferred embodiments of the invention are of approximately conventional tee weight and size so that it may be used in normal play except when in violation of golf competition regulations. Adhesive means may be applied to any conventional golf tee including those having a stem designed for improved ground engagement. Two alternate embodiments include additional anti-rotation flanges on the shank of the tee to provide maximum resistance to tee rotation in the ground and, therefore, to enhance golf ball anti-spin properties of this invention.

6 Claims, 6 Drawing Figures

GOLF TEE

BACKGROUND OF THE INVENTION

This invention relates generally to golf tees and particularly to golf tees which modify or otherwise improve the flight of a golf ball which has been struck by a golf club in the normal manner from a tee. The golf tee in this invention eliminates or reduces the effect of any undesirable rotational input from contact with the head of the golf club, and, therefore reduces or eliminates hooking and slicing of the ball in flight.

There have been other golf tee devices which generally have attempted to improve a player's accuracy in guiding a golf ball. In U.S. Pat. No. 3,782,723, the inventor therein disclosed a tee which was shaped to eliminate golf ball/tee head interference as the ball flies from the tee. U.S. Pat. No. 3,947,027 also discloses a tee shaped to pivot away from the club head just prior to golf ball impact for the same purpose, i.e. to prevent disruption of the intended ball trajectory. U.S. Pat. No. 4,192,504 discloses a tee shaped for improved trajectory alignment and length of ball flight.

Two U.S. patents have been addressed to the partial objective of this invention. U.S. Pat. No. 1,573,911 teaches a golf tee which includes an elastic ring of rubber or the like having yielding lugs for retaining the ball on a corrugated head tap surface. This device, although arguably effective in reducing ball spin, as elaborate and expensive. The device disclosed in U.S. Pat. No. 4,103,888 is intended to specifically by suction means in an elaborate base, improve one's golf game by providing additional resilient resistance to the golf ball's club impact, thus increasing distance achieved by a given club impact.

The present invention is specifically intended to reduce or eliminate the rotational spin imparted to a less than perfectly struck golf ball, thus reducing the tendency of the ball to curve in one direction or another ("slicing" to the left or "hooking" to the right). by simple inexpensive means, which is readily carriable in hand, pocket or golf bag, optionally reuseable, this invention has accomplished the above objective.

BRIEF DESCRIPTION OF THE INVENTION

An improved golf tee comprising a tee body and adhesive means. The body includes a stem portion for penetration into the ground, and a head portion for supporting a golf ball thereon. The adhesive means is applied to all or a part of the socket or upwardly concave portion of the head for adherence to the golf ball placed upon the head of the tee. The adhesive means may be formed of double-sided tape or may be applied in liquid form and covered for storage. The stem may include additional ground engagement flanges to enhance the golf ball anti-spin properties of this invention.

The adhesive means is sufficiently strong to provide the necessary adhesion between the golf ball and the tee head so that, regardless of improper club impact, ball spin is reduced as the ball leaves the tee after club impact. This spin reduction has the desired effect of reducing "hook" or "slice", which are generally undesirable golfing styles imparted to the ball by an improper golf club swing.

Adhesive means may be applied to any conventional golf tee head socket, including those tees already designed for increased ground engagement.

It is therefore an object of this invention to provide a golf tee which reduces the rotation of a golf ball in flight.

It is another object of this invention to provide a golf tee which reduces the undesirable characteristics of golf ball hook or slice.

It is still another object of this invention to achieve the above objectives by providing a golf tee which is inexpensive and readily transportable and storable in the normal course of playing golf.

It is yet another object of this invention to accomplish the above objectives by including adhesive means onto the socket portion of a generally conventional golf tee.

In accordance with these and other objects which will be apparent hereinafter, the instant invention will now be described with particular reference to the accompanying drawings.

PREFERRED EMBODIMENT OF THE INVENTION

Figure 1:
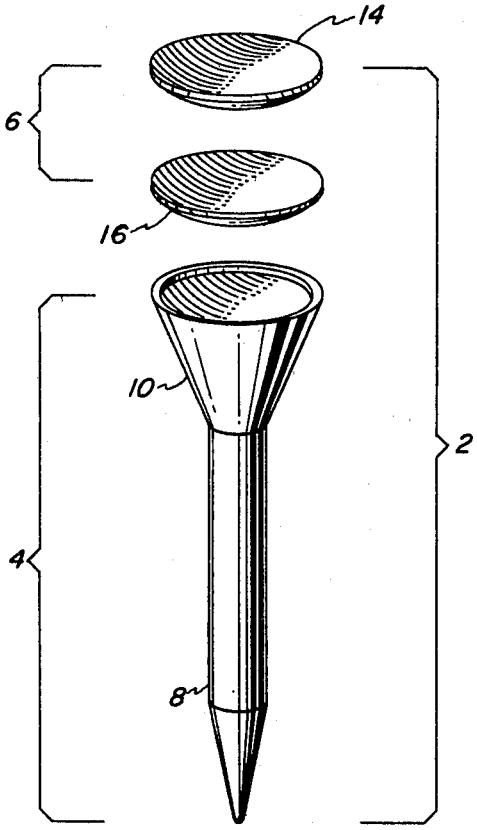
FIG. 1 is an exploded perspective view of the invention.
Figure 3:
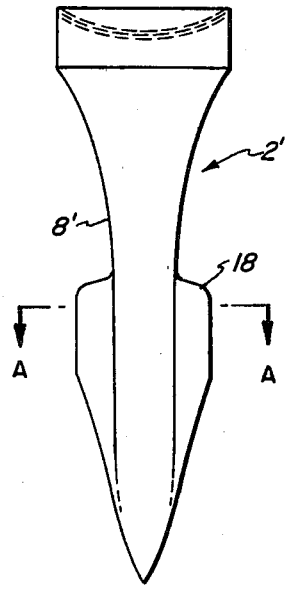
FIG. 3 is a front elevation view of a first alternate embodiment of this invention.
Figure 4:
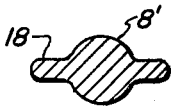
FIG. 4 is a cross-section plan view of FIG. 3 through section A—A.
Figure 2:
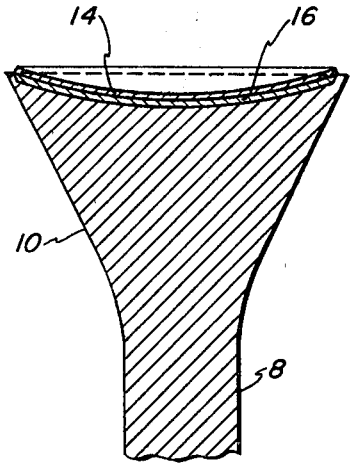
FIG. 2 is a cross-sectional elevation view along the centerline of the invention.
Figure 5:
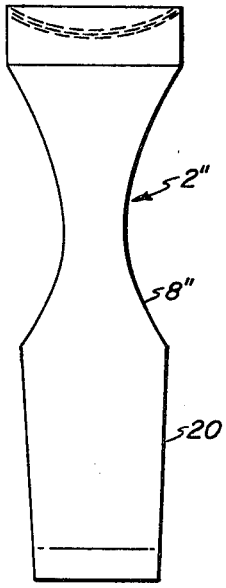
FIG. 5 is a front elevation view of a second alternate embodiment of this invention.
Figure 6:
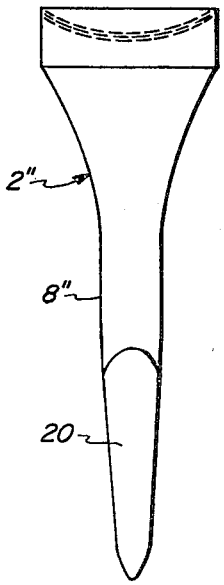
FIG. 6 is a side elevation view of the same embodiment as in FIG. 5.

Referring now to the drawings, the improved golf tee is shown generally at 2 in FIG. 1 and includes a conventional golf tee 4 and adhesive means 6 applied to the socket or concave surface 12 of the head 10 of the tee. The adhesive means 6 includes the adhesive strip 16 and may include a cover 14 over the adhesive strip if protection during storage is desired. It is preferred however, to use a double sided tape such as that manufactured by 3M Co., product identification #465. This double-sided tape strip 16 includes a cover 14 on one side to prevent inadvertent adherence to other objects until the tape is put into full service.

Any conventional golf tee may be employed having a straight stem 8 or a stem having improved ground engagement characteristics (not shown). However in the preferred embodiment, a slightly enlarged head 10 is also employed to allow increased surface adhesion area contact between the concave socket area and the golf ball. Although the adhesive strip may cover only a portion of the socket 12, the entire area is covered by the adhesive strip in the preferred embodiment.

Two alternate embodiments of this invention are shown in FIGS. 3 through 6. These embodiments provide stems 8' and 8'' which include additional ground engaging means in the form of lateral flanges 18 in FIGS. 3 and 4 and a widened blade portion 20 to the lower stem 8'' in FIGS. 5 and 6. These ground engaging means provide additional golf ball anti-spin properties by allowing the stem to more fully resist the ball rotational forces that the adhesive is capable of transmitting from the inadvertently spun golf ball to the tee stem.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved golf tee for reducing undesirable golf ball rotation during flight after being struck by a golf club, said tee comprising:

a golf tee having a head portion and an elongated stem portion;

said head portion having an upwardly concaved socket portion for supporting a golf ball;

said stem portion positioned beneath said head portion for penetration into and support from the ground; and an adhesive means;

said adhesive means attached to at least a portion of said socket portion; p1 said adhesive means for releasable attachment to a golf ball placed on said tee;

said adhesive means for effecting said reduction in golf ball rotation.

2. An improved golf tee as set forth in claim 1 wherein said adhesive means is double-sided tape.

3. An improved golf tee as set forth in claim 1, further comprising:

a protective cover for said adhesive means;

said cover removable for normal golf play;

said cover for preventing undesired adhesion of said tee to objects other than a golf ball placed on said tee.

4. An improved golf tee as set forth in claim 1 wherein said stem portion includes:

additional ground engaging means providing additional anti-rotational strength to said tee when said stem is manually embedded into the ground.

5. An improved golf tee as set forth in claim 4 wherein said additional ground engaging means includes at least one flange connected to said stem extending radially outward from the longitudinal axis of said stem and said tee.

6. An improved golf tee as set forth in claim 1 wherein said elongated stem portion includes a widened blade-shaped distal end portion for providing additional anti-rotational strength to said tee when said stem is manually embedded into the ground.

* * * * *